United States Patent [19]

Sokol

[11] 4,130,046

[45] Dec. 19, 1978

[54] BRAIDING MACHINE WITH CONTINUOUS TENSION FILAMENT CONTROL

[76] Inventor: Vincent Sokol, 93 Sunnyside Dr., Yonkers, N.Y. 10705

[21] Appl. No.: 877,980

[22] Filed: Feb. 15, 1978

[51] Int. Cl.[2] ..... D04C 3/42; D04C 3/06

[52] U.S. Cl. ..... 87/48; 87/44

[58] Field of Search ..... 87/44–48, 87/33, 34

[56] References Cited

U.S. PATENT DOCUMENTS

| | | | |
|---|---|---|---|
| 1,058,100 | 4/1913 | Rankin | 87/46 |
| 1,516,568 | 11/1924 | Horn | 87/48 |
| 1,921,174 | 8/1933 | Tober | 87/48 |
| 2,464,899 | 3/1949 | Sokol | 87/48 |
| 2,672,071 | 3/1954 | Marogg | 87/46 |
| 2,696,836 | 12/1954 | Caldes | 87/48 X |
| 3,892,161 | 7/1975 | Sokol | 87/48 X |
| 4,034,642 | 7/1977 | Iannucci et al. | 87/48 |
| 4,034,643 | 7/1977 | Iannucci et al. | 87/48 |

*Primary Examiner*—John Petrakes

*Attorney, Agent, or Firm*—Ostrolenk, Faber, Gerb & Soffen

[57] ABSTRACT

A machine for braiding filaments around a common axis including: two coaxial annular arrays of filament bobbins; there are filament guides for the radially outer array which alternately move their filaments radially inwardly of and then radially outwardly of the alternate ones of the radially inner array of bobbins; the motion of the filament guides is coordinated with the positions of the inner array of bobbins; one embodiment of the improvement relates to the filaments from the outer array of bobbins being maintained at a constant tension, without tensioning compensation means being required, as the filament guides shift the filaments from the outer array alternately radially inwardly and radially outwardly of the radially inner array of bobbins; in the other embodiment, the support for the braiding machine carries deflectors for deflecting the outer array bobbin filaments radially inwardly or outwardly, and the deflectors are adjustably positionable around the periphery of the inner bobbin array for enabling the deflectors to be used for rotations of the bobbin arrays in reverse directions.

64 Claims, 8 Drawing Figures

FIG. 1
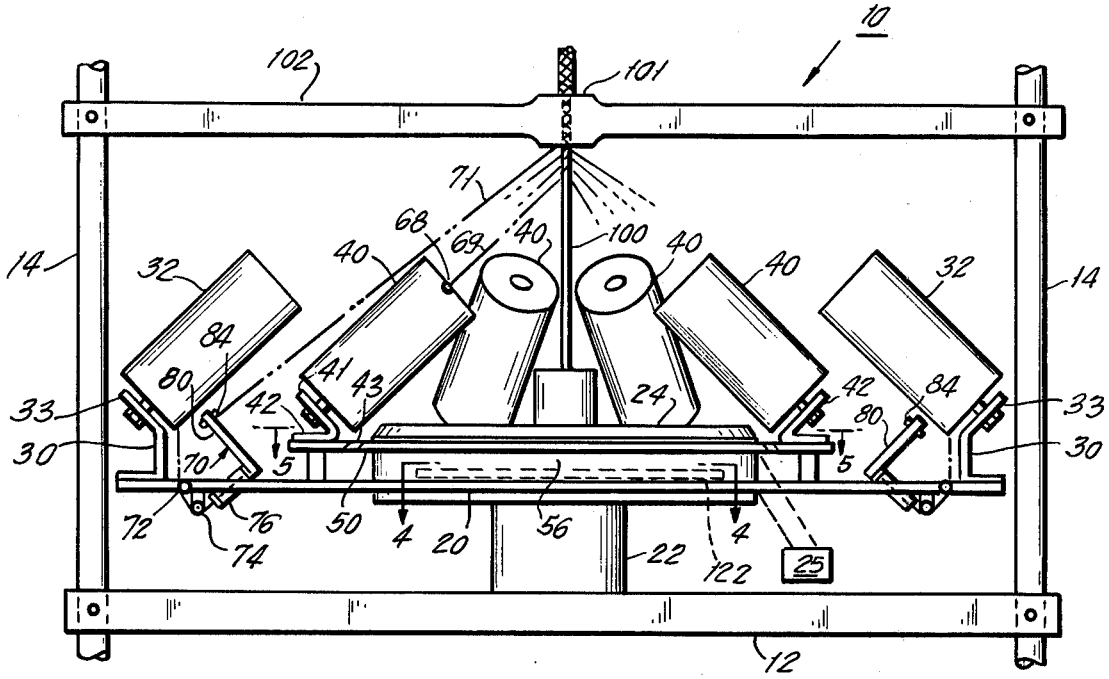
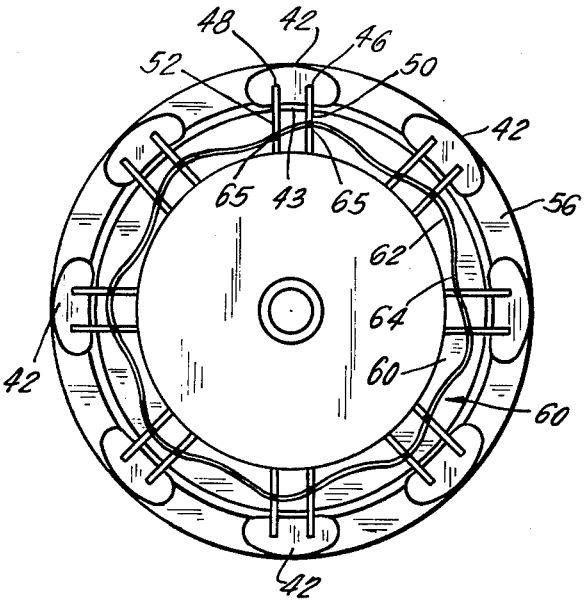
FIG. 5
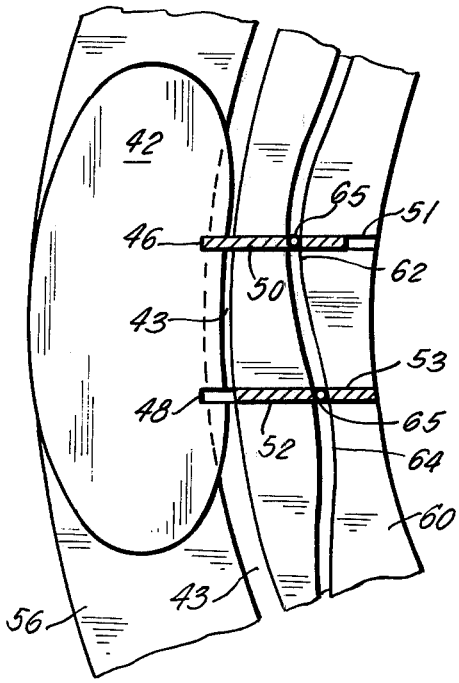
FIG. 5a

FIG. 2
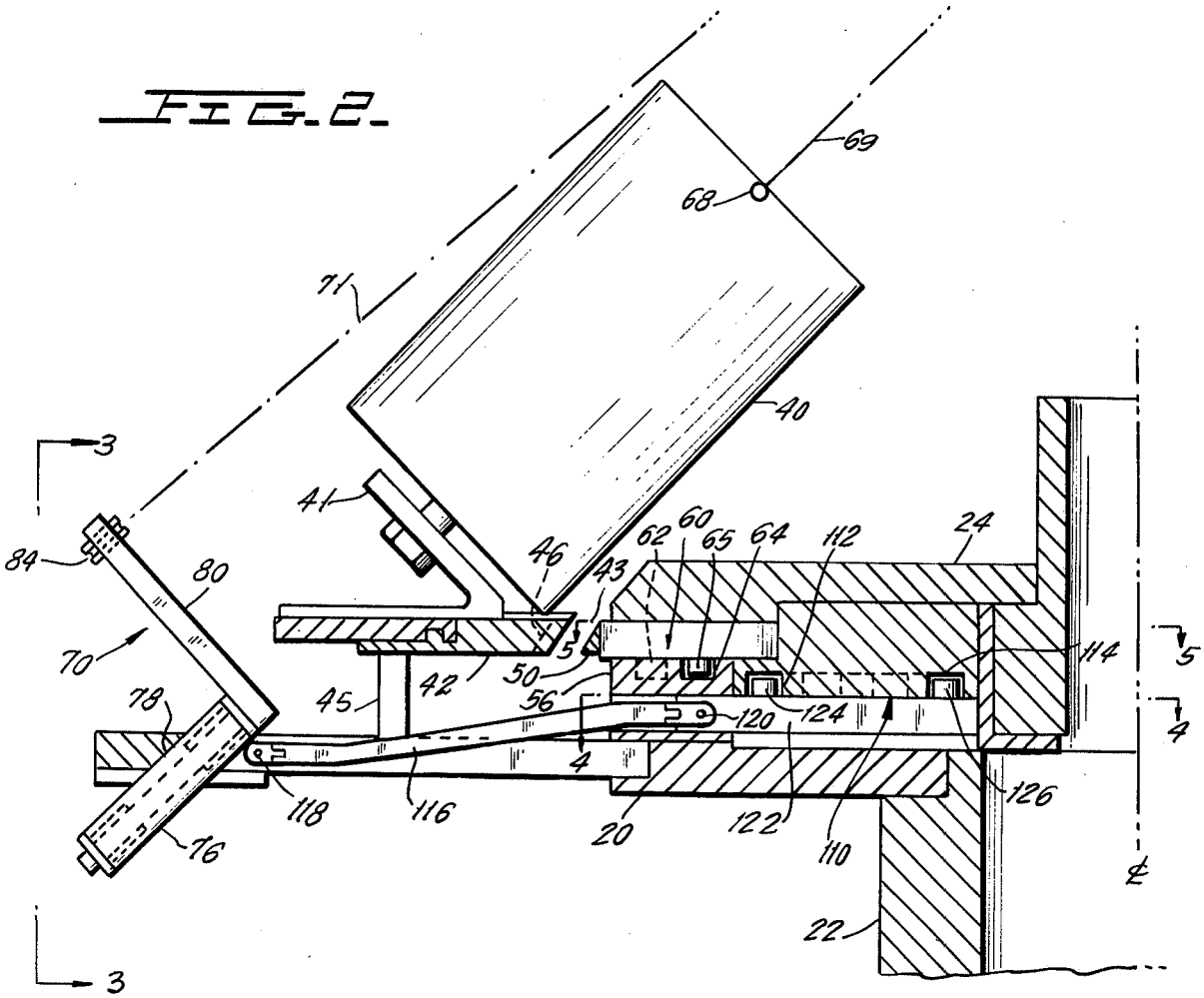
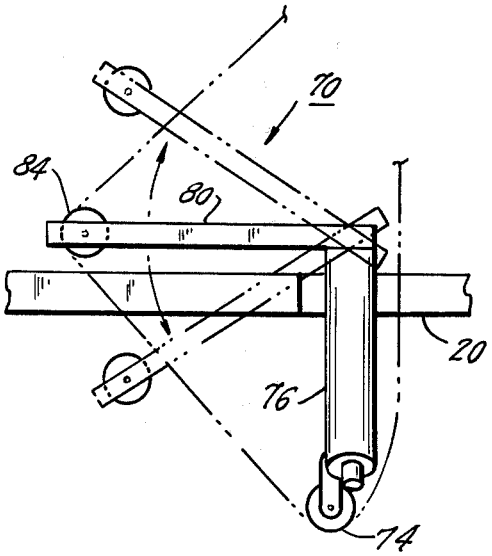
FIG. 3
FIG. 4
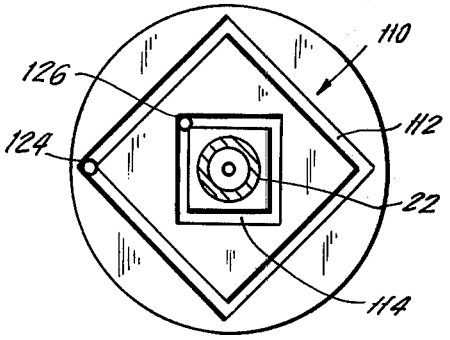

BRAIDING MACHINE WITH CONTINUOUS TENSION FILAMENT CONTROL

BACKGROUND OF THE INVENTION

1. Field of the Invention

The invention relates to braiding machines for filaments and particularly to braiding machines of this type in which two annular arrays of bobbins of filaments of wire, yarn, or the like revolve about a common axis and filament from each of the bobbins is wrapped about this axis, with the filaments from one array being shifted radially inwardly and outwardly of the filaments from the inner array as both bobbin arrays are rotating in opposite directions so as to wind the filament about the axis.

2. Description of the Prior Art

This invention is an improvement upon the braiding apparatus described in my prior U.S. Pat. Nos. 2,464,899 and 3,892,161, both of which earlier patents are incorporated herein by reference.

Both of my earlier patents disclose wire or other filament braiding machines for braiding filaments about a common central axis. Each machine comprises a radially more inward array of bobbins, or reel type filament carriers, or other filament dispensers and the inner array bobbins are rotatable together around the axis in one direction. Each machine also comprises a radially more outward array of similar bobbins, carriers or other filament dispensers rotatable together around the common axis in the opposite direction. As each array rotates, its bobbins supply filament to and wind the filament around a mandrel at the axis.

Respective guide means associated with each outer array bobbin direct the filament therefrom alternately radially inwardly of and outwardly of the annular path of the inner bobbin array as the bobbin arrays rotate. This produces the braid. In both of my prior patents, each guide means comprises a respective guiding tube having an inlet for filament from the respective bobbin and an outlet for the filament. The tube form is not a required feature of the guide means and any other similarly functioning filament supporting structure would suffice. In both of these patents, the tube shifts radially with respect to the axis from a position where the filament exiting from the outlet of the tube would be radially outward of the inner array of bobbins to a position where the filament exiting from the tube outlet would be radially inward of the inner array of bobbins. The respective guide means move annularly around the axis with the radially outward array of bobbins. Means are provided for coordinating this radial shifting of the outlet from the guide means tube with the opposite annular motion of the inward bobbin array to avoid contact between the tubes and the bobbins.

After a filament guiding tube has shifted so that the filament exiting therefrom is radially inward of a bobbin of the inner array, the filament passes inwardly of that inner array bobbin as that inner array bobbin rotates past the tube. Then the guiding tube moves the filament exiting therefrom radially outwardly between the inner array bobbin that has just rotated past the tube and the next inner array bobbin. The filament exiting from the guiding tube passes outwardly of that next inner array bobbin as that inner array bobbin rotates past the filament exit. Next, the guiding tube shifts the filament exiting therefrom radially inwardly between the inner array bobbin it has just passed and the next inner array bobbin. In this manner, each inner array bobbin is eventually passed on all sides by one or another of the filaments exiting from the guiding tubes.

Although the description in the patent is particularly directed to the filaments from each outer array bobbin shifting down between one pair of inner array bobbins and then shifting out between the next adjacent pair of inner array bobbins, by a simple redesign of the camming or other means that controls the guiding tubes, each such filement may pass radially outwardly of two or more of the inner array bobbins before shifting inwardly and then may pass radially inwardly of two or more of the inner array bobbins before shifting radially outwardly.

In both of my prior patents, the filament guide means comprise tubes that shift by pivoting so that the outlets from the guiding tubes move radially inwardly toward the axis of rotation of the array of bobbins and then move radially outwardly away from the axis of rotation of the array of bobbins. When the guide means shifts inwardly, it necessarily somewhat reduces the tension on the filament, even when spring biased compensating or tensioning means are employed for maintaining the tension on the filament at a substantially constant level during the radial shifting of the guide means. When the guide means moves outwardly, on the other hand, it necessarily increases the tension on the filament, again despite any idler or tensioning means. Because precisely uniform tension cannot be maintained, there is a slight adverse effect upon the uniformity of the quality of the resultant braid of filament that is produced. A braider which uses a compensator or web tensioning means may be adequate when a cheaper type of braid is being wound, for example, inexpensive threads or wires. However, where precise braiding is required, as with high tension wire, variations in the tension of the filament, despite the presence of a compensating or tensioning means, is highly undesirable.

In other known braiding machines, shifting of the filaments of the outer array bobbins radially inwardly and outwardly of the inner array bobbins is accomplished by filament engaging deflection cams or deflectors positioned so as to be periodically engaged by each radially outer bobbin array filament as the braid is being wound. In one known arrangement, the filament deflectors are generally fixedly positioned and supported on the frame of the braiding machine so that the outer array filaments engage the deflectors as they move by. Each outer array filament is fed through a feeding element positioned so as to normally feed the filament radially inwardly of the inner array bobbins, and the deflectors are so shaped and placed as to lift each filament as it engages each deflector to raise the outer array filament so as to be radially outside of the inner array bobbin then passing by.

In another aspect of these apparatus, the deflectors are one-way bobbin motion deflectors in that they are shaped to raise the filament radially outwardly as the outer array bobbins are moving in a main winding direction. However, should the rotation direction of the outer bobbin array be reversed, for example, in the event that it is necessary to partially unwind the braid for any reason or if it is desired to wind the braid in the opposite direction, the deflectors are not shaped to desirably deflect the filaments radially outwardly past the inner array bobbins but instead the deflectors will simply snag the filaments and tear them.

As an outer bobbin array filament disengages from a deflector so as to move radially inwardly between two inner array bobbins, it should be free of any contact with the deflector. During movement of the outer bobbin array in the reverse direction, the known deflector will not be present to lift the outer array filament from between the two inner array bobbins because that deflector had been positioned to be out of the outer array filaments moving in the main winding direction and moving between the inner array bobbins. It would be helpful, therefore, for a deflector to be repositionable so that it would properly deflect the outer array filament regardless of which direction the filament array bobbins rotate.

SUMMARY OF THE INVENTION

The braiding machine of the invention is adaptable for winding in two different modes. In one mode, there is constant tension on the outer array bobbin filaments, without the use of a compensator or filament tensioning means. The other mode, through a minor substitution of elements, uses deflector means, but the deflector means of the invention adapt the braiding machine to rotate in opposite directions.

Both embodiments of braiding machine of the invention use the same basic structure of the braiding machine shown in my U.S. Pat. No. 3,892,161 incorporated herein by reference. There are a few basic areas in which the braiding machine has been changed in the present invention.

In the constant filament tension embodiment, instead of shifting radially inwardly and outwardly toward the axis or mandrel or core onto which the filament is braided, the guide means all move along a pathway that causes the exit from each guide means to generally define a plane that is substantially perpendicular to that general direction in which the respective filament extends from the guide means exit toward the axis or mandrel. (The direction of extension of the filament also changes as the exit from the guide means moves, since the point on the mandrel to which the braid is applied remains the same as the guide means exit moves. But, there is a general direction of extension of the filament.) The plane through which the guide means exit is moving is a plane measured relative to or from the viewpoint of the outer array bobbins. Because the bobbin arrays are rotating, with respect to the braiding machine, the guide means exits are defining a circular pathway. In keeping with the previous description of the swiveling motion of each guide means exit, depending upon the direction of extension of the filament toward the mandrel, each guide means exit moves through and defines a cylindrical or a frusto-conical shell with a side wall oriented such that a line extending longitudinally along the surface of such shell will be substantially perpendicular to the direction of extension of the filament from that guide means exit.

Because each guide means only moves substantially within its respective aforesaid plane, the exit from the guide means is not shifting with respect to the length of the section of the filament that extends from the guide means entrance, past its exit and to the mandrel, whereby the guide means does not increase the tension upon the filament when the guide means moves in one direction and does not decrease the tension on the filament when the guide means moves in the other direction. By moving as described, the guide means moves the filament through the above noted plane so as to raise the filament above the top of one inner array bobbin and thereafter to dip the filament below the next inner array bobbin. The result with respect to the movement of the filament inside of and outside of the inner array bobbins is the same as in my prior patent.

In a preferred version of this embodiment of my invention, each guide means comprises a swivelable filament support, having one end portion that is pivotably mounted to swivel with respect to the respective outer array bobbin and having another end portion remote from the first end portion which provides an exit for the filament material from the guide means. The pivot for the swiveling support is oriented around an axis which causes the filament at the guide means exit to swivel substantially through the above described plane. For example, in the illustrated version, the filament is fed to the axis, core or mandrel along a pathway that intersects the direction of extension of the axis or mandrel at an acute angle. As a result, the swiveling support swivels the filament exit of the filament guide means generally in a plane that is oblique to the plane of rotation of the inner array bobbins and the outer array bobbins and at an angle that is substantially complementary to the angle at which the filament intersects the mandrel. It is apparent that as the angle at which the filament meets the mandrel varies, the orientation of the plane through which the filament guide means exit moves should correspondingly be reoriented to maintain continuous tension upon the filament as it is being braided.

For swiveling each guide means through its respective plane, the guide means is connected with a cam means. The shape of the cam means controls the extent and timing of the motion of the guide means. One form of cam means is illustrated in my prior patent. This cam means has undesirable height, which should be avoided.

In a preferred version of this embodiment of the present invention, the cam means comprises a cam plate or disc, preferably quite flat, and connected with the inner array bobbins to rotate together with them. A cam follower arm connects each filament guide means with the cam means on the cam plate for causing the guide means to move as required. In the illustrated version, which includes swivelable guide means, the swivelable guide means are each connected by a universal swivel joint to a cam follower arm and the cam follower arm is, in turn, in engagement with the cam means, whereby the rotation of the cam plate in and through a plane generally parallel to the plane of rotation of the inner array bobbins, through the universal swivel connection of each cam follower with its swivel arm, causes the above described swiveling motion of the swivelable guide means in a plane that intersects the bobbin rotation plane.

As described in my prior patent, in order to obtain properly timed shifting of the outer bobbin array filaments, wherein the guide means are all moving outer array filaments radially inwardly and later radially outwardly of the inner array bobbins simultaneously, the cam means according to the present invention comprises two cam follower guide pathways on the same cam plate, with the cam follower guide pathways being offset from each other or out of phase by an angle such that all guide means spaced at angular intervals around the apparatus swivel simultaneously to raise the filaments above the inner array bobbins and thereafter to dip the filaments below these bobbins. In a typical arrangement wherein the braiding machine is braiding eight inner array filaments with eight outer array filaments and wherein each outer array filament moves radially inwardly through the opening between two inner array bobbins and then moves radially outwardly through the next adjacent opening between inner array bobbins, the cam means comprises two essentially concentric square cam follower guide pathways, with the cam followers for the swivel supports of alternate guide means engaging in the alternate cam follower guide pathways. The square cam follower guide pathways are offset from each other around the cam plate by 45°. So that the cam follower guide pathways do not intersect each other, one square shaped cam follower guide pathway has longer sides than the other. To compensate for the different sizes of the cam follower guide pathways, the respective cam follower arms connected to the swivelable guide means are appropriately adjusted in length.

As noted above, the above described apparatus braids the outer array filaments over one bobbin, under the next bobbin, over the next bobbin, etc. Within the contemplation of this invention, each outer array filament may be braided such that it passes over two or more inner array bobbins before dipping under these bobbins. Appropriate reshaping of the cam follower guide pathways on the cam will enable appropriate motion of the cam followers and of the swivel supports. Furthermore, with a different number of bobbins in the inner or outer array, the cam follower guide pathways would be appropriately reshaped further so as to assure the desired swiveling radially inward and radially outward motion of the bobbin guide means.

In order for each outer bobbin array filament to pass radially inwardly of a respective inner array bobbin, at some time, the outer array filament must pass the means which drives the inner array bobbins to rotate. Each inner array bobbin is connected by two circumferentially spaced apart fingers with the means that rotates the inner array bobbins. The fingers are spaced apart so that as an outer array filament passes beneath an inner array bobbin, before it contacts one of the two fingers, that finger moves out of the way; and after the filament has passed that bobbin moving finger, that finger returns to engagement with the inner array bobbin and the other finger for that inner array bobbin moves out of the way until the outer array filament finally passes by. In my prior patent, the inner array bobbin moving fingers comprise cam controlled radially swiveling fingers which swivel into and out of engagement with the respective inner array bobbins in the proper time sequence for effective operation.

It has been found according to the invention that more effective connection between the inner array bobbins and the means which causes them to rotate can be obtained using longitudinally movable, inner bobbin driving fingers, which shift longitudinally across the gap between the inner array bobbins and the means which drive same, thereby to engage with and disengage from the inner array bobbins as and after the outer array filament passes by. The longitudinally movable fingers are readily controlled from a flat, short height cam disc, which is another benefit of this invention.

Furthermore, the longitudinally movable fingers ride in respective guide slots in the means that drive the inner array bobbins to rotate. Although those guide slots might be oriented radially with respect to the path of rotation of the inner array bobbins, it has been found for ease of formation and for most effective finger motion without wear that the fingers for each inner array bobbin should be parallel to one another, instead of diverging along respective radii, and each finger extends parallel to the bobbin array radius midway between them.

The other embodiment of the invention is created by elimination of the swivelable guide means and substitution therefor of a set of deflectors for deflecting the outer array filaments radially inwardly and radially outwardly as a particular embodiment requires and it further comprises an appropriate compensating or tensioning means for each outer array filament.

One of the benefits of the apparatus of the invention is its easy convertibility between a constant filament tension apparatus of the first embodiment or a deflectable filament arrangement of the second embodiment.

According to the second embodiment, filament from each outer array bobbin is directed at an orientation that would normally deliver that filament radially inwardly of all of the inner array bobbins. For any outer array filament to pass radially outwardly of an inner array bobbin, it must be deflected that way. To this end, a set of deflectors is attached to the braiding machine. The deflectors are so placed on the braiding machine that they raise and permit the lowering of the outer array filaments at the appropriate time when the inner array bobbins are passing by.

To permit rotation of the bobbins in their main rotation directions, the deflectors each have an inclined pathway defined thereon for raising the filaments radially outwardly. When an outer array bobbin filament has been lifted radially outwardly of and passes beyond the respective inner array bobbin, the deflector at that location releases the filament to drop back to its radially inward position. Because of the placement of the deflectors and the spacing of the inner array bobbins, the filament drops between two adjacent inner array bobbins to pass radially inwardly of the next inner array bobbin in line. The deflector is shaped to release the filament to fall radially back before the whole inner array bobbin, and particularly the base or support bracket thereof, has passed fully by the deflector, whereby the filament falls off the deflector and is then engaged by and then falls past the support for the respective inner array bobbin. This ensures that the filament properly moves between adjacent inner array bobbins and ensures that slight misplacement of the deflectors will not prevent proper radially inward motion of the outer array bobbin filaments.

To enable reverse rotation of the braiding machine according to this embodiment of the invention, and in contrast with the prior art, each deflector also has a second inclined pathway extending in the opposite circumferential direction over the deflector from the first inclined pathway, whereby when the bobbin arrays are rotated in the reverse direction, the outer array filament may contact the second inclined pathway of a deflector and be lifted above the respective inner array bobbin.

As noted above, it is beneficial to have the outer bobbin array filament contact the deflector so as to be raised by the deflector over the inner array bobbin, but at the conclusion of its travel past the respective inner array bobbin, it should be released from being supported thereby. To be able to have each deflector operate in the manner described above as the bobbin arrays are rotated in opposite directions, the deflectors are shiftable circumferentially around the axis of the bobbin arrays, and they are shiftable so that the respective inclined pathways for each deflector are operative to lift an outer array filament above an inner array bobbin. The total circumferential length of the deflectors is shortened enough so that when one inclined pathway of the deflector contacts an outer array filament, the other inclined pathway is moved to a position where it does not block the outer array filament from dropping back between the next adjacent pair of inner array bobbins.

The deflectors may be individually shiftable. In another version, they all are carried on a common rotatable support, like an annular rail or ring, so that all deflectors can be shifted together.

The foregoing description has been premised on the braiding machine producing a 1:1 braid where each outer bobbin array filament is passed radially outside of one inner array bobbin and then radially inside the next adjacent inner array bobbin. However, other braiding arrangements are possible where an outer array filament is to pass outside of or inside of more than one consecutive inner array bobbin. In that case, each deflector has a sufficient circumferential length around the bobbin arrays so as to keep the outer array filaments upraised radially outwardly of two or perhaps more of the inner array bobbins before permitting the filaments to drop back radially inside the inner array bobbins. Similarly, the deflectors might be spaced apart sufficiently for an outer bobbin array filament to pass radially inside of two or more inner array bobbins before the outer array filament is raised radially outwardly of the next adjacent inner array bobbin.

Accordingly, it is the primary object of the present invention to provide a simple and practical braiding machine for wire, yarn or any other filaments which are braided.

It is another object of the invention to provide simple and effective means for guiding the filaments as they are braided.

Yet another object of the invention is to control the guiding means for the filaments as they are braided.

Still another object of the invention is to braid the filaments without changing the tensions on the filaments as the braiding operation is carried out.

A further object of the invention is to coordinate the motion of the filament guide means with the rotation of the filament dispensing bobbins.

It is another object of the invention to provide a braiding machine which deflects filaments, rather than guiding them, in order to braid the filament.

It is a further object of the invention to provide a braiding machine which is adapted to be converted between guiding filaments and deflecting filaments for braiding different filaments and/or for braiding filaments according to these different techniques.

It is yet another object of the invention to provide such a braiding machine which can be operated to rotate in opposite directions for either braiding or unbraiding filament, as desired.

The foregoing and other features and objects of the invention will become apparent from the following description of the invention, taken in conjunction with the accompanying drawings.

BRIEF DESCRIPTION OF THE DRAWINGS

FIG. 1 is an assembly view showing one embodiment of a braiding machine adapted with the present invention;

FIG. 2 is an enlarged fragmentary view of the braiding machine embodiment shown in FIG. 1;

FIG. 3 is an end view in the direction of arrows 3 in FIG. 2 of the guide means for the braid in this embodiment;

FIG. 4 is a plan view in the direction of arrow 4—4 of FIGS. 1 and 2 showing the cam used for guiding the motion of the guide means for the braidable filament;

FIG. 5 is a plan view along arrows 5—5 in FIGS. 1 and 2 showing the cam used for guiding the motion of the fingers that move the outer array of bobbins for the braidable filament;

DESCRIPTION OF A PREFERRED EMBODIMENT

Figure 6:
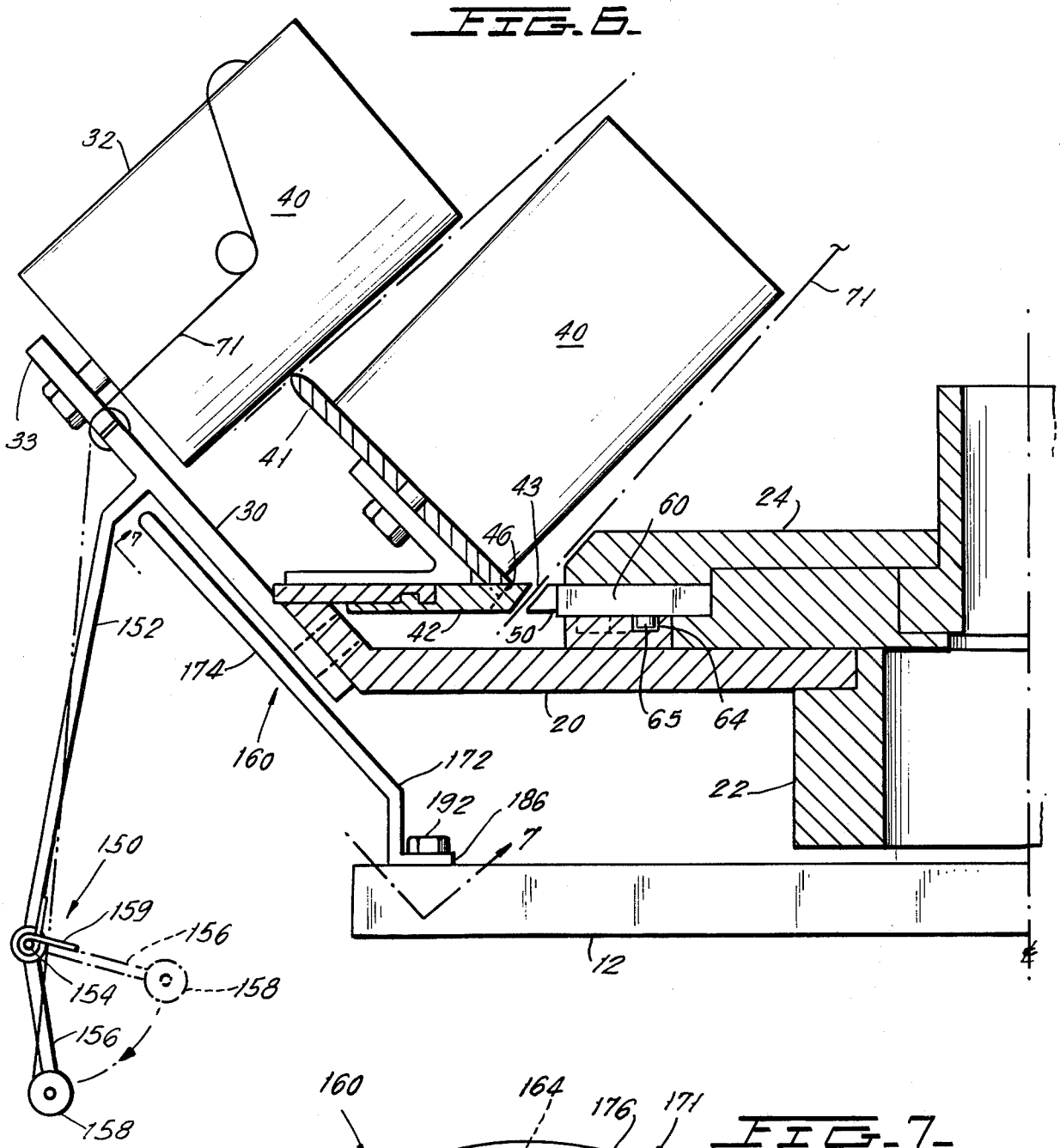
FIG. 6 is an enlarged fragmentary view, from a similar viewpoint as FIG. 2, but showing the braiding machine adapted with the second embodiment of the invention.

Referring to FIG. 1, an embodiment of a braiding machine 10 adapted with the present invention is shown. The principal features of this machine are of the same type as those disclosed in my prior U.S. Pat. No. 3,892,161, incorporated herein by reference. Therefore, much of the details of the braiding machine which are disclosed in my prior patent are not repeated herein.

The braiding machine 10 is supported on a lower, annular support or platform 12 which in turn supports the upright vertical posts 14.

There is a lower annular plate 20 which is rotatably supported at a bearing on a post 22 that is carried on the frame 12. The plate 20 rotates in one direction, e.g. clockwise. Positioned above the plate 20 at another bearing on the post 22 is a second annular plate 24. Plate 24 is rotatable in the opposite direction to plate 20, e.g. counterclockwise. The plates 20 and 24 are rotatable at the same rate of speed relative to the stationary platform 12, so that all filament lengths are uniform as they are being braided. Appropriate drive means 25 (like that described in my U.S. Pat. No. 3,892,161) are connected to the plates for moving them in the manner just described.

On the upper surface of the lower plate 20 near its periphery are mounted a plurality of annularly, uniformly spaced apart supporting brackets 30. On each bracket 30, there is supported a respective filament carrying bobbin 32 of a radially outer array of bobbins. The brackets 30 have upper bobbin supporting sections 33, which are tilted such that the axes of the bobbins 32 are oriented to tilt and slant inwardly toward the below described central core or mandrel 100 on which the filaments are braided. The brackets 30 and the bobbins 32 rotate together with the plate 20. The filament supplies may be the spool-like bobbins 32 or may alternatively be reels or any other filament dispensers. The filaments wound upon the bobbins 32 and upon the below described inward array bobbins 40 may be of wire, yarn, thread or any other filament material.

There is a second, radially more inward, annular, uniformly spaced apart inner array of spool-like bobbins 40. Bobbins 40 may, like bobbins 32, be replaced by other filament dispensers. The type of filaments bobbins 32 and 40 dispense are usually the same. Each bobbin 40 is supported by a respective support bracket 42 having a tilted upper support plate 41 for carrying the bobbin 40. By means described below, each bracket 42 is connected to the rotatable plate 24. Each bobbin support plate 41 and, therefore, the axis of each bobbin 40 is also obliquely tilted toward the mandrel 100. For minimizing the total required swivel motion of the below described swivelable guide means 70, the bobbins 40 are tilted at the same angle as the direction toward which the filaments therefrom extend toward the mandrel 100. Upon rotation of the plate 24 counter to the rotation of the plate 20, the individual support brackets 42 and the bobbins 40 are rotated counter to the rotation of the plate 20.

The bobbin support brackets 42 do not sit upon the plate 24, and the plate 24 does not extend annularly outwardly to the bobbin support brackets 42. Instead, each support bracket 42 is supported in its illustrated position and is guided for annular rotation by appropriate supports 45 provided beneath the brackets 42 and which are supported on the plate 20. This supports the brackets 42 in the illustrated position while also permitting the brackets 42 to rotate with respect to the plate 20. Further detail as to a precise embodiment of a support, like support 45, for each bracket 42 can be found in my prior patent, incorporated herein by reference.

The individual bobbins 40 and their supports 42 are spaced by a gap 43 from the adjacent periphery of the plate 24 in a manner which permits a filament 71 from an outer array bobbin 32 to pass under each bobbin 40, i.e. between the bracket 42 and the plate 24, during the braiding operation. But, the support brackets 42 must still be joined to the plate 24 in order to rotate together with the plate 24.

With references to FIG. 5, the underside of each support bracket 42 includes the slot shaped openings 46 and 48 at opposite annular sides of the bracket 42. The respective pair of openings 46 and 48 for each support bracket 42 are oriented parallel to each other and parallel to that radius of the plate 24 that is midway between them.

There are respective bobbin drive pins 50 and 52 for being received in the openings 46 and 48, and the direction of extension and direction of longitudinal motion of pins 50, 52 is determined by the respective common direction of extension of each opening pair 46, 48.

There is defined in plate 24 respective slot openings 51 and 53 for receiving and for guiding the respective drive pins 50, 52 only for longitudinal movement. The slot openings 51 and 53 are aligned with and extend toward the respective slot openings 46, 48 in the respective brackets 42. Drive pins 50 and 52 are long enough to always be received and guided in the respective slot openings 51 and 53, thereby to assure their above described parallel orientation throughout their respective longitudinal motions. The longitudinal motion of all of the drive pins 50 and 52 is in the direction parallel to the plane of the cam disc 56, whereby the fingers are easily operated and occupy little volume during their operation.

Camming means drive the cam following bobbin drive pins 50 and 52 into and out of the respective receiving bracket openings 46 and 48 for maintaining continuous engagement between the plate 24 and all of the bobbins 40. The top surface of the plate 20 carries a flat cam disc 56, shown in greater detail in FIG. 5. Disc 56 is oriented parallel to and rotates with plate 20. There is cut into the surface of the cam disc 56 a profiled groove cam 60 comprising a plurality of radially outwardly projecting lobes 62 which alternate with a plurality of radially more inward lobes 64. Each of the drive pins 50 and 52 for all of the inner array bobbin support brackets 42 include a respective cam follower boss 65 that continuously rides in the groove cam 60. The lobes 62 and 64 of the groove cam 60 are shaped so that at all rotational positions of the bobbins 40 and the plate 24 with respect to the plate 20 and the bobbins 32, at least one of the pins 50 and 52 for each of the support brackets 42 is in its respective slot 46 or 48, whereby every support bracket 42 and its respective bobbin 40 will continuously rotate together with the plate 24. This cam and cam following bobbin drive pin arrangement is an improvement upon the pivotable fingers described in my previous U.S. Pat. No. 3,892,161 for performing the same function.

Each bobbin 40 of the radially more inward array thereof is provided with a respective filament guide 68 which is secured on the respective support 42 thereof and through the eye of which the filament 69 from the bobbin 42 is led to the central axis or mandrel 100.

In order to form a braided filament, the filaments 71 from the bobbins 32 of the radially outer array are guided to alternately pass inside of and, therefore, below and then outside of and, therefore, above the filaments 69 from alternate bobbins 40 of the radially inner array. Such shifting of the filament from the bobbins of the outer array is accomplished by means of the swivelable guiding means 70. From each outer array bobbin 32, a filament 71 is unwound and passes around the guide roller which is supported beneath plate 20 and then passes around the guiding roller 74 that is supported on the tube 76. The tube 76 passes through a bearing and support opening 78 provided therefor in the plate 20. The opening 78 is slanted at an oblique angle with respect to the plane of rotation of the plate 20. The end of the tube 76 above plate 20, its outlet end, supports the perpendicular cross tube 80, which serves as a filament swivel guide or arm. From the roller 74, the filament 71 is wrapped around the redirecting guide roller 84 that is supported at the end of the guide 80. From the guide roller 84, the filament 71 extends straight to the mandrel 100 at the central axis. The length of the swivel guide 80 is sufficient to enable the filament 71 exiting off the roller 84 to sweep through the desired pathway, which causes the filament to move from a position outside and above one respective inward array bobbin 40 to a position inside and below the next respective bobbin 40 in sequence.

The swivel guide 80 pivots about the bearing in opening 78. The swivel axis of the guide 80 is oriented at an appropriate tilt to cause the roller 84 to sweep generally through a plane that is substantially perpendicular to the general direction of extension of the filament 71 toward the central axis or mandrel 100. As shown in FIG. 1, the filaments 69 and 71 do not intersect the mandrel 100 perpendicularly to the direction of extension of the mandrel. Instead, the filaments intersect the mandrel at an acute angle. It is apparent that as the swivel guide 80 swivels, the distance of the pulley 84 from the central braid support and mandrel will remain substantially the same. Furthermore, the length of the filament pathway from the entrance of the tube 76 to the pulley 84 remains constant. As a result, as each filament 71 is being fed to the mandrel 100 for braiding and while the filament is moving under and over the bobbins 40, the tension thereon is not alternately increased and decreased with undesirable effect, as occurs with the radially moving guide means in my prior patent. The motion of the roller 84 is in or defines a plane only when the motion of the guide 80 and roller 84 is viewed from the vantage point of the plate 20 on which each guide 80 is supported. From the vantage point of the braiding machine as a whole, at the same time as the guide 80 is swiveling, it is also rotating with the plate 20. Therefore, the guide 80 and its roller 84 are not defining a plane as they swivel, but are defining a frusto-conically shaped shell whose annular wall is substantially perpendicular to the general direction of extension of the filament 71 toward the central axis or mandrel 100.

When the swivel guide 80 and its pulley 84 are swiveled upwardly, to the solid line position in FIG. 3, the filament 71 from the outer array bobbin 32 has been upraised above the top side of the respective inner array bobbin 40 that is then passing by and the filament 71 passes radially outwardly of the filament 69 from the respective inner array bobbin 40. When the swivel guide 80 is swiveled so that the pulley 84 moves downwardly to the broken line position of FIG. 3, the filament 71 from the outer array bobbin 32 has been dipped below the underside of the respective inner array bobbin 40 that is then passing by and the filament 71 passes radially inwardly of the respective filament 69. This is the same function that is performed by the radially shiftable guide means shown in my prior patent.

When the filament 71 from an outer array bobbin 32 is passing above and radially outwardly of an inner array bobbin 40, neither the bobbin 40, nor its support 42 nor the plate 24 will interfere with the passage of the filament 71. However, when the filament 71 dips beneath and radially inwardly of an inner array bobbin, it would strike either the inner array bobbin or the connection thereto from the plate 24. To avoid this possibility, the above described shiftable cam follower pins 50, 52 are provided. The cam 60 is so placed and shaped with respect to the below described cam 110 that swivels the swivel guide 80 that when the filament from a roller 84 sweeps downwardly so that an inner array bobbin 40 will pass over it, the filament 71 moves through the slot 43 defined between the support 42 and the plate 24. The slot 43 is normally bridged by both of the pins 50 and 52 for each support 42. But, the cam 60 times the longitudinal movements of the fingers 50, 52 so that just as a filament 71 is about to strike one of these fingers, that finger longitudinally moves into its respective opening 51, 53 and out of the slot 43 to allow the filament 71 to pass, and then the finger returns to its position in the respective engaging slot opening 46, 48 in the support bracket 42. The fingers 50 and 52 are spaced far enough apart and the radially inward lobes 64 of the cam groove 60 are narrow enough in the circumferential direction such that only one pin 50 or 52 at a time is out of engagement with its respective support bracket 42. For further explanation of the nature of the motion of the outer bobbin array filment 71 with respect to the fingers that move the inner array bobbins, note the description of the corresponding features in my prior patent.

With reference to FIGS. 1, 2 and 4, the swiveling of the swivel guide 80 around the swivel axis defined by the opening 78 is caused by the flat, generally planar cam plate 110 which is secured on and beneath the upper plate 24. Cam plates 110 and 56 are parallel. This reduces the volume filled by the braiding machine and also helps keep the cam caused motion to a desirable minimum. The cam plate 110 includes the radially more outward groove cam 112 which is square in shape and the radially more inward groove cam 114 which is also square in shape. The cam grooves are concentric. They are offset from each other by 45° for reasons to be described.

Associated with each of the swivel guides 80 is a respective drive arm 116 which is connected at one end by a universal swivel connection 118 to the respective swivel guide 80 and is connected at the other end by a respective universal swivel connection 120 to a cam follower slide 122 that is supported in the respective plate 20 The cam follower slides 122 carry respective cam follower elements 124 or 126 thereon for engaging in the respective cam grooves 112 or 114. It is apparent that the distance between a bobbin support 42 and the cam 112 is shorter than the distance between a support 42 and the cam 114. Therefore, the slides 122 for carrying the cam follower elements 124 can be shorter. The cam follower elements 124, 126 move around the pathways defined by the cams 112, 114 and the respective slides 112 shift axially in the slots provided therefor in the plate 20 as the slides 122 rotate with the plate 20. The radial movement of each slide 122 with respect to plate 20 is transmitted through the shaft 116 to the swivel guide 80 and causes the above described swiveling thereof.

There are two groove cams 112, 114 and they are offset from each other by 45° in order to ensure that all swivel guides 80 are caused to swivel in the same direction at the same time. One cam follower 122, 124 is in engagement with the groove cam 112 and the adjacent, neighboring cam followers 122, 126 are in engagement with the groove cam 114. Because of the squared shapes of the groove cams 112, 114 and because this embodiment has eight outer array bobbins, every cam follower 122, 124 or 122, 126 is continuously in engagement with the same spot on its respective square shaped groove cam at any point in time, whereby all swivel guides 80 will swivel in the same direction together.

It is apparent that if there is a different number of bobbins, the shape and angular orientations of the groove cams in the cam plate 110 would have to be changed so that all of the guide means of the outer array bobbins would swivel together in the same direction at the same time. If a different pattern of motion of the swivel guides is desired, e.g. it is desired that they swivel independently in different directions, rather than together, then, as will be apparent to one skilled in the art, the configuration of the groove cam or cams would be changed to obtain the appropriate motion. Furthermore, in the description herein, the cams 112, 114 are shaped to cause the filament from each outer array bobbin to pass radially inwardly of one inner array bobbin and then radially outwardly of the next adjacent inner array bobbin. In other braiding arrangements, the filament of an outer array bobbin is to pass over and/or under two or more inner array bobbins. To appropriate shaping of the cams 112 and/or 114 to accomplish such movement of the outer array bobbin swivel guides 80 should be apparent to one skilled in this art.

The filaments from both the inner array and the outer array bobbins are wound upon the common central axis or mandrel 100. This may comprise a wire or tube or any other element on which it is desired to braid filament. Mandrel 100 passes through the guiding die 101 which is centrally supported by the arms 102 that extend inwardly from the posts 14.

Figure 7:
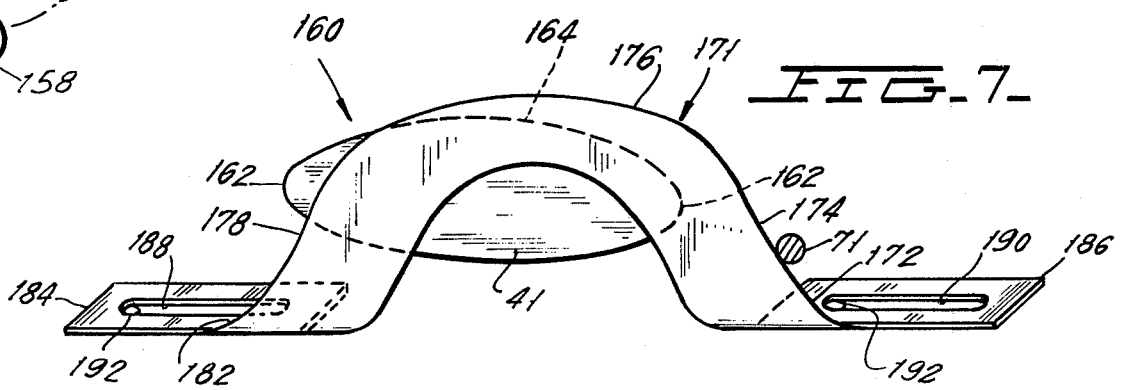
FIG. 7 is an elevational view of a deflector for the embodiment of FIG. 6 viewed in the direction of arrows 7 in FIG. 6.

The second embodiment of braiding machine shown in FIGS. 6 and 7 is, as a further development of the invention, a simple modification of the apparatus making up the first embodiment. In the second embodiment, the guide means 76, 80 is removed. The cam 110 and the elements joining the guide means to the cam are disconnected or removed. Of course, the outer bobbin array filaments still must be upraised radially outwardly of the inner array bobbins and be permitted to return radially inwardly of the inner array bobbins and for performing this function, deflectors 160 are provided. In FIGS. 6 and 7, which show the second embodiment, elements which are the same as those in the first embodiment of FIGS. 1 and 2 are identically numbered. The changed or substituted elements, of course, carry different reference numerals. Elements not shown in FIGS. 6 and 7 are the same as in FIGS. 1 and 2.

Turning to FIG. 6, the outer array bobbin 32 is supported on the bracket support 30, 33. Although the bracket support shape illustrated in FIG. 6 differs from that shown in FIG. 1, the shaping of the plate 20 and of the bracket support 30, 33 positions the outer array bobbin 32 in the same position as shown in FIG. 1. The filament 71 from the outer array bobbin 32 passes around the compensator means 150 which, through spring bias, seeks to maintain substantially constant tension on the filament 71. The compensator means comprises the support arm 152 which is rigidly connected to and depends downwardly from the outer array bobbin bracket support 30. At the lower end of the arm 152 is a pivot connection 154 at which the pivotable arm 156 is pivotally supported. At the end of the arm 156 is the freely rotatably supported pulley 158 about which the filament 71 is wrapped. Spring means 159 at pivot 154 normally presses against arms 152 and 156 for urging arm 156 to pivot clockwise around pivot 154 and the spring 159 exerts a substantially constant spring force, thereby to maintain substantially constant tension on the filament 71. The lengths and positions of the arms 152, 156, of the pivot 154 and of the pulley 158 are selected so that with the pulley 158 in its solid line, lower position in FIG. 6, the filament 71 is directed so as to be able to pass through the gap 43 between the plate 24 and the support bracket 42 for the inner array bobbin, i.e. the outer array bobbin filament is normally radially inwardly of the inner array bobbins.

For purposes of lifting the outer array bobbin filaments 71 radially outwardly of the inner array bobbins 40, a plurality of deflectors 160 are positioned around the axis 22 of the machine. The deflectors are shown as being stationarily attached to the support 12, whereby the outer and inner array bobbins 32, 40 both rotate past the deflectors 160 in opposite directions. It is the purpose of the deflectors 160 to raise each outer array bobbin filament 71 radially outwardly of the inner array bobbin then passing by.

In the 16 bobbin (8 inner, 8 outer) array of the illustrated embodiment, wherein the braiding is performed with the outer bobbin array filament passing radially outside one inner array bobbin and then radially inside the next adjacent inner array bobbin, four deflectors 160 are mounted equidistantly spaced around the support 12 and they are placed so that an inner array bobbin and an outer array bobbin pass one another as they are also passing a delfector 160.

The deflector 160 is shaped to enable the braiding machine bobbin arrays each to rotate in opposite directions, one direction being the usual direction in which the braid is wound, but the other direction being the braid unwinding direction.

Referring to FIG. 7, the upstanding arm of the support bracket 41 beneath the inner array bobbin 40 is generally "boat" or pointed end oval shaped with its side ends 162 being pointed and its top and bottom sides 164 being symmetrically curved around the middle of the bracket 41.

It is intended that as the filament 71 first meets the deflector 160 during rotation of the bobbin arrays, the filament 71 gradually slides up the deflector, passes over the deflector as the inner array bobbin is passing by and then drops away from the deflector when the inner array bobbin has nearly completed passing by. Starting at the right in FIG. 7, and assuming that the outer array bobbins 32 are proceeding clockwise with respect to the apparatus shown in FIGS. 6 and 7, the upper edge surface 171 of the deflector 160 starts at 172 beneath the point of initial engagement between the filament 71 and the deflector 160. The upper edge 171 slopes upwardly over section 174 until it reaches its top part 176 which is higher than the top side 164 of the bracket 41. At the other side of the top portion 176 of the deflector 160 there are correspondingly sloped main section 178 and bottom section 182 which are correspondingly shaped and positioned to the deflector edge sections 174 and 172. The length of the top portion 176 of the deflector upper edge 171 is significant. As shown in FIG. 7, the filaments 71 must ride up on the deflector 160. However, at the exit, or left side in FIG. 7, from the deflector, the filament 71 does not ride down the entire down slope 178, 182 of the deflector 160. Instead, the filament slips off the deflector 160 and falls against the rounded downwardly sloping part of the upper edge 164 of the bobbin support bracket 41, and the filament eventually falls off the left end 162 of the bracket 41. As a result, the outer bobbin array filament 71 drops back radially inwardly between two adjacent inner array bobbins 40 by falling off the support 41 of the first of those bobbins it has passed. Therefore, the filament will always predictably pass between the bobbins and not be carried by the deflector past the gap between the two adjacent bobbins.

With the deflector in the position illustrated in FIG. 7, were the bobbin arrays now to be rotated in the opposite direction, the filaments 71 of each outer array bobbin would be approaching each deflector 160 from the left in FIG. 7, rather than from the right. Its first contact with the sloping part 182 of the deflector 160 would take place while the filament 71 was already beneath the bracket 41 for the inner array bobbin. Were the filament 71 to then ride up the inclined edge 182, 178 of the deflector 160, it would snag beneath the bracket 41.

To avoid this, the deflector 160 is adapted to be shifted a short distance circumferentially around the braiding machine to a position (not illustrated in the drawings) at which the side thereof including the edge slope 182, 178 extends beyond the left end 162 of the support 41 the same distance as it is illustrated in FIG. 7 as extending beyond the right end 162 of the support 41. Now, the filament 71 will easily ride up the upper side edge 182, 178 and to the top 176 of the deflector 160 when the bobbin arrays are rotated in the reverse direction. Similarly, at the end of the passage of the inner array bobbin 40 past the deflector 160, the filament 71 will fall off the deflector 160 and onto the top edge 164 of the bracket 41, thereby to be readily guided between the adjacent inner array bobbins.

For facilitating the aforesaid position adjustment of the deflector 160, it is illustrated as including support brackets 184, 186 at its opposite bottom ends and in which are defined respective elongated slots 188, 190. A respective tightening screw 192, or the like, passes through the slots 188, 190 and into an appropriately threaded receiving hole (not shown) in the support 12, whereby the deflector 160 is securely held to the support 12. Loosening of the screws 192 permits the deflector 160 to be shifted circumferentially between its above described positions. Such adjustability in the position of the deflector is also of considerable importance for properly positioning the deflector with respect to the inner and outer array bobbins so that the deflector will properly lift the filament 71 just as the outer array bobbin is passing the inner array bobbin 40, and not too early or too late.

In an alternate arrangement (not shown), all of the plurality of deflectors shown on the support 12 may be carried on an annular rail which itself includes an elongated slot therein and which itself is held to the support 12 by a fastening means like fastening means 192, whereby adjustment of the position of the rail correspondingly simultaneously adjusts the positions of all of the deflectors.

The deflectors rapidly raise the filament 71 over the inner array bobbins 40. The compensator absorbs this rapid rise and reduces or minimizes the resulting increases and decreases in the tension on the filament 71. When the filament 71 is raised to ride above the top edge 176 of the deflector 160, the compensator pulley 158 moves to the elevated position shown in broken lines in FIG. 6 and when the filament 71 is passing through a gap 43, the pulley 158 is in its solid line position in FIG. 6.

Although the deflector 160 is shown in an arrangement wherein the outer array bobbin filament 71 is passed radially outside of only one inner array bobbin before it is permitted to pass radially inwardly of the next inner array bobbin, it is apparent that appropriate lengthening of the top edge 176 of the delfector 160 will cause the filament 71 to pass radially outside of a plurality of inner array bobbins before dropping back between two adjacent inner array bobbins. Furthermore, although the deflectors are shown as lifting the filament 71 from a position radially inwardly of the inner array bobbin to a position radially outwardly thereof, the deflectors may be somehow reversely shaped and supported so as to deflect the filament from the radially outward position to the radially inward position.

Although the invention has been described in connection with prefered embodiments, it is apparent that many variations and modifictions will now become apparent to those skilled in the art. It is preferred, therefore, that the present invention be limited not by the specific disclosure herein, but only by the appended claims.

What is claimed is:

1. A machine for braiding filaments, comprising:

a mandrel at a central axis on which said mandrel the filaments are braided;

an array of first bobbins, or the like, each for supplying a respective filament to be braided; first moving means for supporting and for moving said first bobbins annularly around said central axis in a first direction; each said first bobbin having a top side and an underside;

an array of second bobbins, or the like, each for supplying a respective filament to be braided;

a respective filament guide means for each said second bobbin; the filament from each said second bobbin being guided by its said filament guide means; second moving means for supporting and for moving said guide means annularly around said central axis in a second direction opposite said first direction; each said guide means having an entrance thereto at which filament from the respective said second bobbin enters said guide means; each said guide means having an exit therefrom out of which filament leaves the respective said guide means; said guide means exits all being further from said mandrel than said first bobbins;

said second moving means comprises a support for each said guide means which is connected with the respective said second bobbin that supplies filament to that said guide means such that the location of each said guide means entrance remains fixed with respect to the location of the respective said second bobbin, while each said guide means exit moves with respect to said second bobbin as said guide means is moved;

said guide means each being movable in a manner that raises and lowers said guide means filament exits, raising the filament exiting from each said guide means exit to a level at which the filament passes over a said first bobbin top side and lowering the filament exiting from each said guide means exit to a level at which the filament passes under said first bobbin underside; said guide means exits each being movable along a pathway wherein the tension on the filament exiting from each said exit remains substantially constant throughout the movements of said guide means to raise and lower the filament exiting therefrom;

each said guide means being oriented and adapted to move the respective said guide means exit along the respective said pathway, and said pathway is chosen so that the length of a filament section, from said guide exit to said mandrel, remains substantially constant throughout the movement of said guide means exit;

guide means moving means for so moving said guide means;

each said guide means is disengageable from the respective second bobbin array filament connectable therewith;

with first bobbins and said second bobbins also being rotatable in the respective directions opposite to their respective said first and said second rotation directions;

filament positioning means placed so as to direct filament from each said second bobbin to normally pass by one of said top side and said underside of all said first bobbins;

a deflector on said machine; said deflector having a first side edge positioned to be engaged by the filaments of said second bobbins as said second bobbins move past said deflector in the respective said second direction of rotation thereof; said deflector first side edge being shaped to deflect the second bobbin filaments to pass by the other of said top side and said underside of said first bobbin then passing said deflector;

said deflector having a second side edge on the opposite side thereof from said first side edge and positioned to be engaged by the filaments of said second bobbins as said second bobbins move past said deflector in said opposite direction from said second direction; said deflector second side edge being shaped to deflect the second bobbin filaments to pass by the other of said top side and said underside of said first bobbins then passing said deflector;

a frame for supporting said bobbins and with respect to which both of said first and said second bobbins arrays rotate; said deflector being mounted to said frame and being shiftable circumferentially of said bobbin arrays with respect to said frame for positioning either of said first and said second side edges to be engaged by the filaments of said second bobbin array when said second bobbin array rotates, respectively, in said second direction and the direction opposite to said second direction.

2. A machine for braiding filaments, comprising:

a mandrel at a central axis on which said mandrel the filaments are braided;

an array of first bobbins, or the like, each for supplying a respective filament to be braided; first moving means for supporting and for moving said first bobbins annularly around said central axis in a first direction; each said first bobbin having a top side and an underside;

an array of second bobbins, or the like, each for supplying a respective filament to be braided;

a respective filament guide means for each said second bobbin; the filament from each said second bobbin being guided by its said filament guide means; second moving means for supporting and for moving said guide means annularly around said central axis in a second direction opposite said first direction; each said guide means having an entrance thereto at which filament from the respective said second bobbin enters said guide means; each said guide means having an exit therefrom out of which filament leaves the respective said guide means; said guide means exits all being further from said mandrel than said first bobbins;

the filament extending from each said guide means exit to said mandrel extends generally at a respective predetermined angle to said central axis and said pathway of movement of each said guide means exit is substantially in and defines an imaginary shell with an annular side wall that is generally perpendicular to the direction of extension of the respective filament toward said mandrel;

said guide means each being movable in a manner that raises and lowers said guide means filament exits to move the respective said guide means exit along the respective said pathway, raising the filament exiting from each said guide means exit to a level at which the filament pases over a said first bobbin top side and lowering the filament exiting from each said guide means exit to a level at which the filament passes under a said first bobbin underside; said guide means exits each being movable along said pathway wherein the length of a filament section, from said guide exit to said mandrel, remains substantially constant and the tension on the filament exiting from each said exit remains substantially constant throughout the movements of said guide means to raise and lower the filament exiting therefrom;

guide means moving means for so moving said guide means;

said second moving means comprising a support for each said guide means which is connected with the respective said second bobbin that supplies filament to that said guide means such that the location of each said guide means entrance remains fixed with respect to the location of the respective said second bobbin, while each said guide means exit moves with respect to said second bobbin as said guide means is moved;

said guide means moving means comprises:

cam means connected to said guide means for moving all said guide means exits to raise and lower each filament exiting from each said guide means exit;

cam follower means connected to all said guide means; said cam follower means being in engagement with said cam means for being shifted by said cam means; each said cam follower means being so connected with its said guide means that shifting of said cam follower means in a third direction moves said guide means exit to have filament exit above said first bobbin top side, thereby enabling the exiting filament to pass by said first bobbins radially outwardly thereof, and so that shifting of said cam follower means in a fourth direction opposite said third direction moves said guide means exit to have filament exit from said guide means exit below said underside of said first bobbin, thereby enabling the exiting filament to pass by said first bobbins radially inwardly thereof.

3. The braiding machine of claim 2, wherein each said guide means is disengageable from the respective filament connectable therewith;

said first bobbins and said second bobbins also being rotatable in the respective directions opposite to their respective said first and said second rotation directions;

filament positioning means placed so as to direct filament from each said second bobbin to normally pass by one of said top side and said underside of all said first bobbins;

a deflector on said machine; said deflector having a first side edge positioned to be engaged by the filaments of said second bobbins as said second bobbins move past said deflector in the respective said second direction of rotation thereof; said deflector first said edge being shaped to deflect the second bobbin filaments to pass by the other of said top side and said underside of said first bobbin then passing said deflector;

said deflector having a second side edge on the opposite side thereof from said first side edge and positioned to be engaged by the filaments of said second bobbins as said second bobbins move past said deflector in said opposite direction from said second direction; said deflector second side edge being shaped to deflect the second bobbin filaments to pass by the other of said top side and said underside of said first bobbins then passing said deflector;

each said first bobbin being connected with said first moving means through a support bracket on which said first bobbin is supported;

said deflector being shaped and positioned with respect to each said first bobbin passing thereby that the second bobbin filament which is in engagement with one of said opposite first and said second deflector side edges is initially deflected by the one of those said deflector side edges it first engages; said deflector being further shaped so that the filament thereafter separates off said deflector and then contacts the said support bracket for the said first bobbin then passing by, and the filament thereafter separates completely from its deflected condition off the said first bobbin support bracket then passing by;

said deflector being shiftable generally circumferentially of said bobbin arrays for causing either of said deflector first side edge and said deflector second side edge to project past the corresponding side of the said bobbin support bracket of the said first bobbin then passing by for the respective said deflector side edge to be engaged by the second array filament for deflecting that filament around that said first bobbin support bracket then passing by until the filament thereafter separates off said deflector.

4. The braiding machine of claim 2, wherein said cam means is arranged to be generally within a plane parallel to the planes defined by rotation of said bobbin arrays.

5. The braiding machine of claim 4, wherein there are a plurality of said guide means which are uniformly arrayed around said central axis;

said cam means comprising a plurality of cam follower guide pathways; all said guide means rotating around said central axis at the same rate; said cam follower means comprising respective cam followers for each said guide means; said cam followers for adjacent said guide means being received in different said cam follower guide pathways; the two said cam follower guide pathways for said cam followers of adjacent said guide means being shaped to cause said guide means to move together, and the two said cam follower guide pathways being annularly offset around said central axis for causing all said guide means to move together.

6. The braiding machine of claim 5, wherein said cam follower guide pathways are generally within a plane parallel to the planes defined by rotation of said bobbin arrays.

7. The braiding machine of claim 2, wherein said cam means is shaped and adapted to cause all said guide means to move together in the same direction and to cause said guide means to move to shift their filaments through the annular spaces between the counter rotating said first bobbins, without obstructive contact between said first bobbins and the filaments.

8. The braiding machine of claim 2, wherein there are eight of said guide means uniformly arrayed around said central axis;

said cam means comprising first and second cam follower guide pathways; all said guide means rotating around said central axis at the same rate; said cam follower means comprising respective cam followers for each said guide means; said cam followers for adjacent said guide means being received in different ones of said first and second cam follower guide pathways; said cam follower guide pathways for said cam followers of adjacent said guide means being shaped to cause said guide means to move together and said first and second cam follower guide pathways being annularly offset around said central axis for causing all said guide means to move together.

9. The braiding machine of claim 8, wherein said first and second cam follower guide pathways are square in shape and are concentric with respect to said central axis.

10. The braiding machine of claim 9, further comprising said cam means being connected with said first bobbins for rotating together therewith.

11. The braiding machine of claim 10, wherein said cam follower guide pathways are generally within a plane parallel to the planes defined by rotation of said bobbin arrays.

12. The braiding machine of claim 10, wherein said first bobbins are connected by connection means to said first moving means; with said guide means exit moved for the respective filament therefrom to be beneath the respective said first bobbin underside, that filament passes between the respective said first bobbin and said first moving means;

said connection means comprising a pair of fingers spaced apart circumferentially around said central axis and extending between said first moving means and the respective said first bobbin;

second cam means in engagement with said fingers for moving one said finger at a time of each said pair thereof away from connecting said first moving means and the respective said first bobbin for that said finger, as filament from the respective said guide means exit passes by said first bobbin underside.

13. The braiding machine of claim 12, wherein said second cam means comprises a disc having a third cam follower guide pathway therein shaped and positioned for causing second cam followers in engagement therewith to shift toward and away from said central axis; said fingers including second cam followers which are received in said third cam follower guide pathway of said second cam means, whereby said fingers are moved into and out of connection with the respective said first bobbin as said fingers rotate with respect to said second cam means.

14. The braiding machine of claim 13, wherein said fingers of each said pair are oriented parallel to each other and parallel to a radius of said first bobbin array midway between said fingers.

15. The braiding machine of claim 14, wherein each said guide means is disengageable from the respective filament connectable therewith;

said first bobbins and said second bobbins also being rotatable in the respective directions opposite to their respective said first and said second rotation directions;

filament positioning means placed so as to direct filament from each said second bobbin to normally pass by one of said top side and said underside of all said first bobbins;

a deflector on said machine; said deflector having a first side edge positioned to be engaged by the filaments of said second bobbins as said second bobbins move past said deflector in the respective said second direction of rotation thereof; said deflector first side edge being shaped to deflect the second bobbin filaments to pass by the other of said top side and said underside of said first bobbin then passing said deflector;

said deflector having a second side edge on the opposite side thereof from said first side edge and positioned to be engaged by the filaments of said second bobbins as said second bobbins move past said deflector in said opposite direction from said second direction; said deflector second side edge being shaped to deflect the second bobbin filaments to pass by the other of said top side and said underside of said first bobbins then passing said deflector;

each said first bobbin being connected with said first moving means through a support bracket on which said first bobbin is supported;

said deflector being shaped and positioned with respect to each said first bobbin passing thereby that the second bobbin filament which is in engagement with one of said opposite first and said second deflector side edges is initially deflected by the one of those said deflector side edges it first engages; said deflector being further shaped so that the filament thereafter separates off said deflector and then contacts the said support bracket for the said first bobbin then passing by, and the filament thereafter separates completely from its deflected condition off the said first bobbin support bracket then passing by;

said deflector being shiftable generally circumferentially of said bobbin arrays for causing either of said deflector first side edge and said deflector second side edge to project past the corresponding side of the said first bobbin support bracket of the said first bobbin then passing by for the respective said deflector side edge to be engaged by the second array filament for deflecting the filament around that said first bobbin support bracket then passing by until the filament thereafter separates off that said deflector;

said deflector being shaped so that both said first and said second side edges thereof are sloped up to a top side thereof and said deflector having a top side up to which said side edges are sloped; and said deflector top side being higher than said first bobbin support bracket then passing by, whereby a deflected second bobbin array filament is carried over said deflector at least partially past that said first array bobbin support bracket until the filament separates from said deflector to engage that said support bracket.

16. The braiding machine of claim 13, wherein said disc of said second cam means is flat and parallel to the plane defined by rotation of said first bobbin array.

17. The braiding machine of claim 13, wherein said second cam means is connected with said second bobbins for rotating therewith in said second direction counter to the direction of rotation of said first bobbins.

18. The braiding machine of claim 2, wherein said first bobbins are connected by connection means to said first moving means; with said guide means exit moved for the respective filament therefrom to be beneath the respective said first bobbin underside, that filament passes between the respective said first bobbin and said first moving means;

said connection means comprising a pair of fingers spaced apart circumferentially around said central axis and extending between said first moving means and the respective said first bobbin;

cam means in engagement with said pair of fingers for moving one said finger at a time of each said pair thereof away from connecting said first moving means and the respective said first said bobbin for that said finger, as filament from the respective said guide means exit passes by said first bobbin underside.

19. The braiding machine of claim 18, wherein each said guide means is disengageable from the respective filament connectable therewith;

said first bobbins and said second bobbins also being rotatable in the respective directions opposite to their respective said first and said second rotation directions;

filament positioning means placed so as to direct filament from each said second bobbin to normally pass by one of said top side and said underside of all said first bobbins;

a deflector on said machine; said deflector having a first side edge positioned to be engaged by the filaments of said second bobbins as said second bobbins move past said deflector in the respective said second direction of rotation thereof; said deflector first side edge being shaped to deflect the second bobbin filaments to pass by the other of said top side and said underside of said first bobbin then passing said deflector;

said deflector having a second side edge on the opposite side thereof from said first side edge and positioned to be engaged by the filaments of said second bobbins as said second bobbins move past said deflector in said opposite direction from said second direction; said deflector second side edge being shaped to deflect the second bobbin filaments to pass by the other of said top side and said underside of said first bobbins then passing said deflector;

each said first bobbin being connected with said first moving means through a support bracket on which said first bobbin is supported;

said deflector being shaped and positioned with respect to each said first bobbin passing thereby that the second bobbin filament which is in engagement with one of said opposite first and said second deflector side edges is initially deflected by the one of those said deflector side edges it first engages; said deflector being further shaped so that the filament thereafter separates off said deflector an then contacts the said support bracket for the said first bobbin then passing by, and the filament thereafter separates completely from its deflected condition off the said first bobbin support bracket then passing by;

said deflector being shiftable generally circumferentially of said bobbin arrays for causing either of said deflector first side edge and said deflector second side edge to project past the corresponding side of the said first bobbin support bracket of the said first bobbin then passing by for the respective said deflector side edge to be engaged by the second array filament for deflecting the filament around that said first bobbin support bracket then passing by until the filament thereafter separates off that said deflector.

20. The braiding machine of claim 18, wherein said cam means comprises a disc having a cam follower guide pathway therein shaped and positioned for causing cam followers in engagement therewith to shift toward and away from said central axis; said fingers including cam followers received in said cam follower guide pathway of said cam means, whereby said fingers are moved into and out of connection with the respective said first bobbin as said fingers rotate with respect to said cam means.

21. The braiding machine of claim 20, wherein said fingers of each said pair are oriented parallel to each other and parallel to a radius of said first bobbin array midway between said fingers.

22. The braiding machine of claim 20, wherein said disc of said cam means is flat and parallel to the plane defined by rotation of said first bobbin array.

23. The braiding machine of claim 20, wherein said cam means is connected with said second bobbins for rotating therewith in said second direction counter to the direction of rotation of said first bobbins.

24. The braiding machine of claim 2, wherein each said second bobbin and said guide mean support rotates around said central axis with its respective said guide means.

25. A machine for braiding filaments, comprising:

a mandrel at a central axis on which said mandrel the filaments are braided;

an array of first bobbins, or the like, each for supplying a respective filament to be braided; first moving means for supporting and for moving said first bobbins annularly around said central axis in a first direction; each said first bobbin having a top side and an underside;

an array of second bobbins, or the like, each for supplying a respective filament to be braided;

a respective filament guide means for each said second bobbin; the filament from each said second bobbin being guided by its said filament guide means; second moving means for supporting and for moving said guide means annularly around said central axis in a second direction opposite said first direction; each said guide means having an entrance theereto at which filament from the respective said second bobbin enters said guide means; each said guide means having an exit therefrom out of which filament leaves the respective said guide means; said guide means exits all being further from said mandrel than said first bobbins;

said guide means is swivelingly supported on said support thereof such that said guide means exit is swiveled by swiveling of said guide means about a swivel axis and between the positions of filament exiting above the said top side of and exiting below said bottom side of a respective said first bobbin; said swivel axis extends generally parallel to the general direction of extension of filament from said guide means exit to said mandrel;

said guide means swiveling means comprises:

cam means connected to said guide means for swiveling all said guide means exits to raise and lower each filament exiting from each said guide means exit;

cam follower means connected to all said guide means; said cam follower means being in engagement with said cam means for being shifted by said cam means; each said cam follower means being so connected with its said guide means that shifting of said cam follower means in a third direction swivels said guide means exit to have filament exit above said first bobbin top side, thereby enabling the exiting filament to pass by said first bobbins radially outwardly thereof, and so that shifting of said cam follower means in a fourth direction opposite said third direction swivels said guide means exit to have filament exit from said guide means exit below said underside of said first bobbin, thereby enabling the exiting filament to pass by said first bobbins radially inwardly thereof.

26. The braiding machine of claim 25, wherein said cam means is arranged to be generally within a plane parallel to the planes defined by rotation of said bobbin arrays.

27. The braiding machine of claim 25, wherein said cam means is shaped and adapted to cause all said guide means to swivel together in the same direction and to cause said guide means to swivel to shift their filaments through the annular spaces between the counter rotating said first bobbins, without obstructing contact between said first bobbins and the filaments.

28. The braiding machine of claim 27, wherein there are a plurality of said guide means which are uniformly arrayed around said central axis;

said cam means comprising a plurality of cam follower guide pathways; all said guide means rotating around said central axis at the same rate; said cam follower means comprising respective cam followers for each said guide means; said cam followers for adjacent said guide means being received in different said cam follower guide pathways; the two said cam follower guide pathways for said cam followers of adjacent said guide means being shaped to cause said guide means to swivel together, but the two said cam follower guide pathways being annularly offset around said central axis for causing all said guide means to swivel together.

29. The braiding machine of claim 28, wherein said cam follower guide pathways are generally within a plane parallel to the planes defined by rotation of said bobbin arrays.

30. The braiding machine of claim 28, wherein the two said cam follower guide pathways are concentric with respect to said central axis.

31. The braiding machine of claim 30, wherein the two said cam follower guide pathways are identical in shape, with one having shorter dimensions than the other.

32. The braiding machine of claim 30, further comprising said cam means being connected with said first bobbins for rotating together therewith.

33. The braiding machine of claim 27, wherein there are eight of said guide means uniformly arrayed around said central axis;

said cam means comprising first and second cam follower guide pathways; all said guide means rotating around said central axis at the same rate; said cam follower means comprising respective cam followers for each said guide means; said cam followers for adjacent said guide means being received in different ones of said first and second cam follower guide pathways; said cam follower guide pathways for said cam followers of adjacent said guide means being shaped to cause said guide means to swivel together, but the two said cam follower guide pathways being annularly offset around said central axis for causing all said guide means to swivel together.

34. The braiding machine of claim 33, wherein said first and second cam follower guide pathways are square in shape and are concentric with respect to said central axis.

35. The braiding machine of claim 34, wherein said first square cam follower guide pathway has shorter sides.

36. The braiding machine of claim 34, further comprising said cam means being connected with said first bobbins for rotating together therewith.

37. The braiding machine of claim 36, said cam follower guide pathways are generally within a plane parallel to the planes defined by rotation of said bobbin arrays.

38. The braiding machine of claim 36, wherein said first bobbins are connected by connection means to said first swiveling means; with said guide means exit swiveled for the respective filament therefrom to be beneath the respective said first bobbin underside, that filament passes between the respective said first bobbin and said first moving means;

said connection means comprising a pair of fingers spaced apart circumferentially around said central axis and extending between said first moving means and the respective said first bobbin;

second cam means in engagement with said pair of fingers for moving one said finger at a time of each said pair thereof away from connecting said first moving means and the respective said first bobbin for that said finger, as filament from the respective said guide means exit passes by said first bobbin underside.

39. The braiding machine of claim 38, wherein said second cam means comprises a disc having a third cam follower guide pathway therein shaped and positioned for causing second cam followers in engagement therewith to shift toward and away from said central axis; said fingers including second cam followers received in said third cam follower guide pathway of said second cam means, whereby said fingers are moved into and out of connection with the respective said first bobbin as said fingers rotate with respect to said second cam means;

said second cam means being connected with said second bobbins for rotating therewith in said second direction counter to the rotation of said first bobbins.

40. The braiding machine of claim 39, wherein said fingers of each said pair are oriented parallel to each other and parallel to a radius of said first bobbin array midway between said fingers.

41. The braiding machine of claim 40, wherein said disc of said second cam means is flat and parallel to the plane defined by rotation of said first bobbin array.

42. A machine for braiding filaments, comprising:

a mandrel at a central axis on which said mandrel the filaments are braided;

an array of first bobbins, or the like, each for supplying a respective filament to be braided; first moving means for supporting and for moving said first bobbins annularly around said central axis in a first direction; each said first bobbin having a top side and an underside;

an array of second bobbins, or the like, each for supplying a respective filament to be braided; second moving means for supporting and for moving said second bobbins annularly around said central axis in a second direction opposite said first direction;

said first bobbins and said second bobbins also being rotatable in the respective directions opposite to their respective said first and said second rotation directions;

said second bobbins having filament positioning means so placed as to direct filament from each said second bobbin to normally pass by one of said top side and said underside of all said first bobbins;

a deflector on said machine; said deflector having a first side edge positioned to be engaged by the filaments of said second bobbins as said second bobbins move past said deflector in the respective said second direction of rotation thereof; said deflector first side edge being shaped to deflect the second bobbin filaments to pass by the other of said top side and said underside of said first bobbin then passing said deflector;

said deflector having a second side edge on the opposite side thereof from said first side edge and positioned to be engaged by the filaments of said second bobbins as said second bobbins move past said deflector in said opposite direction from said second direction; said deflector second side edge being shaped to deflect the second bobbin filaments to pass by the other of said top side and said underside of said first bobbins then passing said deflector.

43. The braiding machine of claim 42, further comprising a frame for supporting said bobbins and with respect to which both of said first and said second bobbin arrays rotate; said deflector being mounted to said frame and being shiftable circumferentially of said bobbin arrays with respect to said frame for positioning either of said first and said second side edges to be engaged by the filaments of said second bobbin array when said second bobbin array rotates, respectively, in said direction and the direction opposite to said second direction.

44. The braiding machine of claim 42, wherein each said first bobbin is connected with said first moving means through a support bracket on which said first bobbin is supported;

said deflector being shaped and positioned with respect to each said first bobbin passing thereby that the second bobbin filament which is in engagement with one of said opposite first and said second deflector side edges is initially deflected by the one of those said deflector side edges it first engages; said deflector being further shaped so that that filament thereafter separates off said deflector and then contacts the said support bracket for the said first bobbin then passing by, and the filament thereafter separates completely from its deflected condition off the said first bobbin support bracket then passing by.

45. The braiding machine of claim 44, wherein said deflector is shiftable generally circumferentially of said bobbin arrays for causing either of said deflector first side edge and said deflector second side edge to project past the corresponding side of the said bobbin support bracket of the said first bobbin then passing by for the respective said deflector side edge to be engaged by the second array filament for deflecting that filament around that said first bobbin support bracket then passing by until the filament thereafter separates off said deflector.

46. The braiding machine of claim 45, wherein said deflector is shaped so that both said first and said second side edges thereof are sloped up to a top side thereof and said deflector having a top side up to which said side edges are sloped; and said deflector top side being higher than said first bobbin support bracket then passing by, whereby the deflected second bobbin array filament is carried over said deflector at least partially past that said first array bobbin support bracket until the filament separates from said deflector to engage that said support bracket.

47. The braiding machine of claim 45, wherein said deflector has a top side between its said first and said second side edges and said top side being higher than said first bobbin support bracket then passing by, whereby the deflected second bobbin array filament is carried over said deflector at least partially past that said first array bobbin support bracket until the filament separates from said deflector to engage that said support bracket.

48. The braiding machine of claim 45, further comprising a frame for supporting said bobbins and with respect to which both of said first and said second bobbins rotate; said deflector being mounted to said frame and being shiftable circumferentially of said bobbin arrays with respect to said frame for positioning said first and said second side edges to be engaged by the filaments of said second bobbin array.

49. The braiding machine of claim 44, wherein said deflector is shaped so that both said first and said second side edges thereof are sloped up to a top side thereof and said deflector having a top side up to which said side edges are sloped; and said deflector top side being higher than said first bobbin support bracket then passing by, whereby the deflected second bobbin array filament is carried over said deflector at least partially past that said first array bobbin support bracket until the filament separates from said deflector to engage that said support bracket.

50. The braiding machine of claim 44, wherein said deflector has a top side between its said first and said second side edges and said top side being higher than said first bobbin support bracket then passing by, whereby the deflected second bobbin array filament is carried over said deflector at least partially past that said first array bobbin support bracket until the filament separates from said deflector to engage that said support bracket.

51. A machine for braiding filaments, comprising:

a mandrel at a central axis on which said mandrel the filaments are braided;

an array of first bobbins, or the like, each of supplying a respective filament to be braided; first moving means for supporting and for moving said first bobbins annularly around said central axis in a first direction; each said first bobbin having a top side and an underside;

an array of second bobbins, or the like, each for supplying a respective filament to be braided; second moving means for supporting and for moving said second bobbins annularly around said central axis in a second direction opposite said first direction;

said first bobbins and said second bobbins also being rotatable in the respective directions opposite to their respective said first and said second rotation directions;

said second bobbins having filament positioning means so placed as to direct filament from each said second bobbin to normally pass by said underside of all said first bobbins;

a deflector on said machine; said deflector having a first side edge positioned to be engaged by the filaments of said second bobbins at the level of said underside of said first bobbins as said second bobbins move past said deflector in the respective said second direction of rotation thereof; said deflector first side edge being shaped to deflect the second bobbin filaments to pass by said top side of said first bobbin then passing said deflector;

said deflector having a second side edge on the opposite side thereof from said first side edge and positioned to be engaged by the filaments of said second bobbins at the level of said underside of said first bobbins as said second bobbins move past said deflector in said opposite direction from said second direction; said deflector second side edge being shaped to deflect the second bobbin filaments to pass by said top side of said first bobbins then passing said deflector.

52. The braiding machine of claim 51, further comprising a frame for supporting said bobbins and with respect to which both of said first and said second bobbin arrays rotate; said deflector being mounted to said frame and being shiftable circumferentially of said bobbin arrays with respect to said frame for positioning either of said first and said second side edges to be engaged by the filaments of said second bobbin array when said second bobbin array rotates, respectively, in said second direction and the direction opposite to said second direction.

53. The braiding machine of claim 51, wherein each said first bobbin is connected with said first moving means through a support bracket on which said first bobbin is supported;

said deflector being shaped and positioned with respect to each said first bobbin passing thereby that the second bobbin filament which is in engagement with one of said opposite first and said second deflector side edges is initially deflected to be above said top side of said first bobbin then passing by by the one of those said deflector side edges it first engages; said deflector being further shaped so that that filament thereafter separates off said deflector and then contacts the said support bracket for the said first bobbin then passing by, and the filament thereafter separates completely from its deflected condition off the said first bobbin support bracket then passing by.

54. The braiding machine of claim 53, wherein said deflector is shiftable generally circumferentially of said bobbin arrays for causing either of said deflector first side edge and said deflector second side edge to project past the corresponding side of the said first bobbin support bracket of the said first bobbin then passing by for the respective said deflector side edge to be engaged by the second array filament for deflecting the filament around that said first bobbin support bracket then passing by until the filament thereafter separates off that said deflector.

55. The braiding machine of claim 54, wherein said deflector is shaped so that both said first and said second side edges thereof are sloped up to a top side thereof and said deflector having a top side up to which said side edges are sloped; and said deflector top side being higher than said first bobbin support bracket then passing by, whereby the deflected second bobbin array filament is carried over said deflector at least partially past that said first array bobbin support bracket until the filament separates from said deflector to engage that said support bracket.

56. The braiding machine of claim 55, wherein said support bracket of said first bobbin has a curved upper surface with a sloping side sloping generally in the same manner as said first and said second side edges of said deflector and said deflector being so shaped and positioned that the filament separates therefrom and contacts said support bracket at the side of said support bracket opposite the side thereof at which the filament first contacts the deflector, whereby the filament slides down off said support bracket.

57. The braiding machine of claim 54, wherein said deflector has a top side between its said first and said second side edges and said top side being higher than said first bobbin support bracket then passing by, whereby a deflected second bobbin array filament is carried over said deflector at least partially past that said first array bobbin support bracket until the filament separates from said deflector to engage that said support bracket.

58. The braiding machine of claim 54, further comprising a frame for supporting said bobbins and with respect to which both of said first and said second bobbins rotate; said deflector being mounted to said frame and being shiftable circumferentially of said bobbin arrays with respect to said frame for positioning said first and said second side edges to be engaged by the filaments of said second bobbin array.

59. The braiding machine of claim 54, wherein said first bobbins are connected by connection means to said first moving means; with a filament from a said second array bobbin positioned to pass beneath and passing beneath a said first bobbin underside of the said first bobbin then passing that second bobbin array filament, that filament is in position to pass between the respective said first bobbin and said first moving means;

said connection means comprising a pair of fingers spaced apart circumferentially around said central axis and extending between said first moving means and the respective said first bobbin;

cam means in engagement with said pair of fingers for moving one said finger at a time of each said pair thereof away from connecting said first moving means and the respective said first said bobbin for that said finger, as filament from the respective said guide means exit passes by said first bobbin underside.

60. The braiding machine of claim 59, wherein said cam means comprises a disc having a cam follower guide pathway therein shaped and positioned for causing cam followers in engagement therewith to shift toward and away from said central axis; said fingers including cam followers received in said cam follower guide pathway of said cam means, whereby said fingers are moved into and out of connection with the respective said first bobbin as said fingers rotate with respect to said cam means.

61. The braiding machine of claim 60, wherein said fingers of each said pair are oriented parallel to each other and parallel to a radius of said first bobbin array midway between said fingers.

62. The braiding machine of claim 60, wherein said disc of said cam means is flat and parallel to the plane defined by rotation of said first bobbin array.

63. The braiding machine of claim 60, wherein said cam means is connected with said second bobbins for rotating therewith in said second direction counter to the direction of rotation of said first bobbins.

64. The braiding machine of claim 53, wherein said first bobbins are connected by connection means to said first moving means; with a filament from a said second array bobbin positioned to pass beneath and passing beneath a said first bobbin underside of the said first bobbin then passing that second bobbin array filament, that filament is in position to pass between the respective said first bobbin and said first moving means;

said connection means comprising a pair of fingers spaced apart circumferentially around said central axis and extending between said first moving means and the respective said first bobbin;

cam means in engagement with said pair of fingers for moving one said finger at a time of each said pair thereof away from connecting said first moving means and the respective said first said bobbin for that said finger, as filament from the respective said guide means exit passes by said first bobbin underside.

* * * * *